US010095143B1

(12) United States Patent
Veregin et al.

(10) Patent No.: US 10,095,143 B1
(45) Date of Patent: Oct. 9, 2018

(54) HYBRID TONER COMPOSITIONS

(71) Applicant: Xerox Corporation, Norwalk, CT (US)

(72) Inventors: Richard P. N. Veregin, Mississauga (CA); Valerie M. Farrugia, Oakville (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/614,022

(22) Filed: Jun. 5, 2017

(51) Int. Cl.

| | |
|---|---|
| ***G03G 9/087*** | (2006.01) |
| ***G03G 9/093*** | (2006.01) |
| ***G03G 9/08*** | (2006.01) |
| *G03G 9/09* | (2006.01) |

(52) U.S. Cl.
CPC ..... *G03G 9/09357* (2013.01); *G03G 9/0812* (2013.01); *G03G 9/08711* (2013.01); *G03G 9/08755* (2013.01); *G03G 9/08782* (2013.01); *G03G 9/08795* (2013.01); *G03G 9/08797* (2013.01); *G03G 9/09314* (2013.01); *G03G 9/0904* (2013.01); *G03G 9/09392* (2013.01)

(58) Field of Classification Search
CPC ..... G03G 9/08782; G03G 9/08755; G03G 9/08711; G03G 9/093
See application file for complete search history.

(56) References Cited

U.S. PATENT DOCUMENTS

| | | | | |
|---|---|---|---|---|
| 3,590,000 | A | 6/1971 | Palermiti et al. | |
| 4,298,672 | A | 11/1981 | Lu | |
| 4,338,390 | A | 7/1982 | Lu | |
| 6,063,827 | A | 5/2000 | Sacripante et al. | |
| 6,214,507 | B1 | 4/2001 | Sokol et al. | |
| 8,691,488 | B2 | 4/2014 | Davis et al. | |
| 9,046,801 | B2 | 4/2015 | Nosella et al. | |
| 9,128,395 | B2 | 4/2015 | Nosella et al. | |
| 9,341,968 | B1 | 5/2016 | Lawton et al. | |
| 9,383,666 | B1 | 7/2016 | Lawton et al. | |
| 2005/0022992 | A1* | 2/2005 | Di Lullo Arias | C04B 28/04 166/285 |
| 2005/0250031 | A1* | 11/2005 | McDougall | G03G 9/0823 430/108.6 |
| 2008/0081912 | A1 | 4/2008 | Harada et al. | |
| 2008/0261141 | A1 | 10/2008 | Yasukawa et al. | |
| 2009/0214973 | A1* | 8/2009 | Sugimoto | G03G 9/0804 430/108.4 |
| 2011/0053063 | A1* | 3/2011 | Kadota | G03G 9/0825 430/48 |
| 2012/0231385 | A1 | 9/2012 | Tamaki et al. | |
| 2013/0196261 | A1* | 8/2013 | Uchinokura | G03G 9/08 430/105 |
| 2017/0010553 | A1 | 1/2017 | Veregin et al. | |
| 2017/0010554 | A1 | 1/2017 | Veregin et al. | |

OTHER PUBLICATIONS

Richard P. N. Veregin, et al., U.S. Appl. No. 15/187,475, filed Jun. 20, 2016, "Toner Compositions Comprising Crystalline Polyester and Wax," not yet published.
Chukyo Yushi Co., Ltd., "MP-WAX," Brochure, Apr. 22, 2013, 4 pages.
"Calorimeter," available at the online cyclopedia Wikipedia at https://en.wikipedia.org/wiki/Calorimeter#Differential_scanning_calorimeter, last edited Apr. 29, 2018, 8 pages.
"Modulated DSC® (MDSC®): How Does It Work?" available at http://www.tainstruments.com/pdf/literature/MDSC.pdf, undated, 9 pages.
"X-ray photoelectron spectroscopy," available online at https://en.wikipedia.org/wiki/X-ray_photoelectron_spectroscopy, last edited May 14, 2018, 19 pages.

* cited by examiner

*Primary Examiner* — Hoa V Lee
(74) *Attorney, Agent, or Firm* — Marylou J. Lavoie, Esq. LLC

(57) ABSTRACT

A hybrid toner composition including a first wax; a second wax that is different from the first wax; wherein the first wax comprises a paraffin wax having a peak melting point of from about 60 to about 80° C.; wherein the second wax comprises an ester wax having a peak melting point of from about 60 to about 80° C.; a first resin comprising an amorphous polyester resin and at second resin comprising at least one of a styrene, an acrylate, or a combination thereof; and an optional colorant.

24 Claims, No Drawings

HYBRID TONER COMPOSITIONS

BACKGROUND

Disclosed herein is a hybrid toner composition comprising a first wax; a second wax that is different from the first wax; wherein the first wax comprises a paraffin wax having a peak melting point of from about 60 to about 80° C.; wherein the second wax comprises an ester wax having a peak melting point of from about 60 to about 80° C.; a first resin comprising an amorphous polyester resin and a second resin comprising at least one of a styrene resin, an acrylate resin, a styrene-acrylate resin, or a combination thereof; and an optional colorant.

Reduced cost hybrid toner compositions are desired. Hybrid toners having some of the polyester replaced by a styrene/acrylate latex have been proposed for cost reduction. Such toners may be comprised of a core prepared with a polyester amorphous latex, polyester crystalline latex, styrene-acrylate polymer latex, or a combination thereof and may have a shell prepared with a styrene-acrylate polymer latex. A benefit of such a toner is overall reduced cost. However, crystalline polyester resin is expensive due to the raw materials costs and processing costs. Further reduced cost toner having sufficient print characteristics is desired.

U. S. Patent Publication 2017/0010553, which is hereby incorporated by reference herein in its entirety, describes in the Abstract thereof, toner compositions with toner particles having a core-shell type structure, wherein the core comprises a first resin comprising a styrene-acrylate copolymer and an amorphous polyester resin, and the shell comprises a second resin comprising beta-carboxyethyl acrylate in an amount of from about 0.05 pph to about 2.5 pph by weight of the second resin.

U. S. Patent Publication 2017/0010554, which is hereby incorporated by reference herein in its entirety, describes in the Abstract thereof, processes of preparing hybrid toner compositions with toner particles having a core-shell type structure, where the shell contains a non-volatile coalescent agent. More particularly, embodiments relate to processes of preparing styrene-acrylate hybrid toner compositions.

U.S. patent application Ser. No. 15/187,475, which is hereby incorporated by reference herein in its entirety, describes in the Abstract thereof a hybrid toner including a core having at least one amorphous polyester resin and at least one crystalline polyester resin, and at least one styrene/acrylate resin, a shell comprising at least one styrene/acrylate resin, at least one wax, and optionally a pigment dispersion, wherein the first modulated differential calorimetry scan (DSC) of the hybrid toner shows at least two melting point peaks below about 80° C., and the difference between the two melting point peaks is less than or equal to about 15° C. In embodiments, the toner is a hybrid styrene-acrylate polyester toner with crystalline polyester where both wax and crystalline polyester have melting points less than 80° C. and where the toner has two melting peaks in the DSC that are separated by less than 15° C. In embodiments, the wax is a paraffin wax or a polymethylene/polyethylene wax.

U.S. Pat. No. 9,383,666, which is hereby incorporated by reference herein in its entirety, describes in the Abstract thereof toners and processes useful in providing toners suitable for electrophotographic apparatuses, including apparatuses such as digital, image-on-image, and similar apparatuses. In particular, emulsion aggregation toners are described that comprise toner particles having a core composed of either polyester resin or both styrene-acrylate and polyester resins. These embodiments also comprise a shell disposed over the core, wherein the shell comprises styrene-acrylate resin.

U.S. Pat. No. 9,341,968, which is hereby incorporated by reference herein in its entirety, describes in the Abstract thereof a toner composition comprising toner particles with a core and a shell, wherein the core comprises a polyester polymer and a styrene acrylate polymer, and the shell comprises a polyester polymer and, optionally, a styrene acrylate polymer, either or both of which can be the same or different from that in the core.

U.S. Pat. No. 9,128,395, which is hereby incorporated by reference herein in its entirety, describes in the Abstract thereof toners and processes useful in providing toners suitable for electrophotographic apparatuses, including apparatuses such as digital, image-on-image, and similar apparatuses. In particular, emulsion aggregation toner compositions are described that use two different emulsion aggregation (EA) technologies and which comprise a base resin composed of both styrene-acrylate and polyester resins. These toner compositions further include polyaluminum chloride (PAC) instead of the more commonly used aluminum sulfate as the flocculant or aggregating agent.

U.S. Pat. No. 9,046,801, which is hereby incorporated by reference herein in its entirety, describes in the Abstract thereof emulsion aggregation toner compositions that use two different emulsion aggregation (EA) technologies. Namely, there is provided an emulsion aggregation toner that comprises a base resin composed of both styrene-acrylate and polyester resins. Such hybrid emulsion aggregation toner compositions are lower in cost but still maintain desirable developer properties like low minimum fusing temperature (MFT) and lower dielectric loss.

Currently available toner compositions are suitable for their intended purposes. However a need remains for improved toner compositions. Further, a need remains for lower cost toner compositions. Further, a need remains for lower cost toner compositions that can perform as well as toners containing more expensive components such as crystalline polyester which can be prepared at the cost of less expensive components such as styrene-acrylate resins.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a hybrid toner composition comprising a first wax; a second wax that is different from the first wax; wherein the first wax comprises a paraffin wax having a peak melting point of from about 60 to about 80° C.; wherein the second wax comprises an ester wax having a peak melting point of from about 60 to about 80° C.; a first resin comprising an amorphous polyester resin and a second resin comprising at least one of a styrene, an acrylate, or a combination thereof; and an optional colorant.

Also described is a process for preparing a hybrid toner composition comprising mixing a first latex resin comprising an amorphous polyester and a second latex resin comprising at least one of a styrene, an acrylate, or a combination thereof, an optional crystalline polyester latex, an optional colorant, a first wax, and a second wax that is different from the first wax; wherein the first wax comprises a paraffin wax having a peak melting point of from about 60 to about 80° C.; wherein the second wax comprises an ester wax having a peak melting point of from about 60 to about 80° C.; optionally, adding a coagulant to the mixture; heating the mixture to a temperature below the glass transition temperature of at least one of the first latex resin or second latex resin to form aggregated particles; heating the mixture to a temperature above the glass transition temperature of at least one of the first latex resin or the second latex resin to coalesce the aggregated particles; and optionally isolating the toner particles.

Also described is a process for preparing a hybrid toner having a core and a shell, comprising mixing a first latex resin comprising an amorphous polyester and a second latex resin comprising at least one of a styrene, an acrylate, or a combination thereof, an optional crystalline polyester latex, an optional colorant, a first wax, and a second wax that is different from the first wax; wherein the first wax comprises a paraffin wax having a peak melting point of from about 60 to about 80° C.; wherein the second wax comprises an ester wax having a peak melting point of from about 60 to about 80° C.; to form a core mixture; optionally, adding a coagulant to the core mixture; heating the core mixture to a temperature below the glass transition temperature of at least one of the first or second latex resins to aggregate the core mixture to form aggregated core particles; mixing a third latex resin comprising at least one styrene-acrylate resin and a coalescent agent to form a shell mixture; coating the shell mixture onto the aggregated core particles; heating the shell mixture and the aggregated core particles to a temperature above the glass transition temperature of at least one of the first latex resin, the second latex resin, or the third latex resin to coalesce the aggregated core particles to form toner particles; and optionally, isolating the toner particles.

DETAILED DESCRIPTION

A styrene-acrylate polyester hybrid toner composition is provided that provides excellent fusing and blocking comparable to higher cost toner compositions containing crystalline polyester but with reduced amounts of crystalline polyester or even no crystalline polyester. In embodiments, two low melt point waxes, a paraffin wax and an ester wax, are included wherein both waxes melt between an onset temperature of about 60° C. and an offset temperature of about 80° C. The ester wax has a very low carbon to oxygen (C/O) ratio compared to paraffin wax, thus the ester wax replaces some or replaces altogether crystalline polyester to reduce crease minimum fixing temperature while the paraffin wax provides desired release properties. The toner compositions provide low gloss and are particularly suitable for low gloss products such as toners employing a low gloss black colorant.

In embodiments, a hybrid toner composition herein comprises a first wax; a second wax that is different from the first wax; wherein the first wax comprises a paraffin wax having a peak melting point of from about 60 to about 80° C.; wherein the second wax comprises an ester wax having a peak melting point of from about 60 to about 80° C.; a first resin comprising an amorphous polyester resin and a second resin comprising at least one of a styrene, an acrylate, or a combination thereof; and an optional colorant. In embodiments, the first wax comprising a paraffin wax has a low onset melting point of greater than about 50° C. and a peak melting point of from about 60 to about 80° C. In embodiments, the second wax comprising an ester wax has a low onset melting point of greater than about 50° C. and a peak melting point of from about 60 to about 80° C.

Wax.

The hybrid toner compositions herein comprise a first wax and a second wax that is different from the first wax.

In embodiments, the first wax is a paraffin wax having a low onset melting point of greater than about 50° C. or greater than about 60° C. In embodiments, the first wax is a paraffin wax having a peak melting temperature of from about 60 to about 80° C., or from about 70 to about 80° C., or from about 65 to about 75° C. In a particular embodiment, the first wax is a paraffin wax having a low onset melting point of from about 70 to about 75° C. In a certain embodiment, the first wax is a paraffin wax having an onset melting temperature of greater than about 55° C.

Any suitable or desired paraffin wax can be selected for embodiments herein, provided it has the desired peak melting temperature, low onset melting point characteristics, or combination thereof, described herein. In embodiments, the paraffin wax can be selected from the group consisting of BW-422 and BW-436 from Blended Waxes, Inc.; IGI 1245A, IGI 1250A, IGI 1297A, IGI 1266A all from the International Group, Inc.; Indrawax 6062-F, Indrawax 6264-F, Indrawax 6466-F, Indrawax 6668-F, Indrawax 6870-F, Indrawax 7072-F, Indrawax 8070, Indrawax 6062-S 140-144, Indrawax 6062-S all from Industrial Raw Materials LLC, Shell Sarawax SX70 from Alpha Wax, Strahl & Pitsch 434 and 674 paraffin waxes; dispersions of paraffin waxes including CHEMBEAD® 30, CHEMBEAD® 30-AM, PARAFINE 30, PARAFFIN 60, PARAFFIN EMULSION 135-45 FDA, PARAFFIN EMULSION 150-45 FDA, all from BYK Additives & Instruments, and combinations thereof.

The first wax, in embodiments, the paraffin wax, can be provided in the toner at any suitable or desired amount. In embodiments, the first wax is provided in an amount of from about 2 to about 4, from about 1 to about 4, or from about 1 to about 9 percent by weight based upon the total weight of the toner composition.

In embodiments, the first wax is a paraffin wax having a carbon to oxygen ratio (C/O ratio) of from about 100 to about 200, or from about 50 to about 150, or from about 100 to about 200. In embodiments, the first wax is a paraffin wax having a carbon to oxygen ratio of greater than about 50.

In embodiments, the second wax is an ester wax having a peak melting temperature of from about 60 to about 80° C., or from about 60 to about 70° C., from about 65 to about 80° C., or from about 60 to about 75° C. In embodiments, the second wax is an ester wax having a low onset melting point of greater than about 50° C., or greater than about 60° C. In a particular embodiment, the second wax is an ester wax having a low onset melting point of from about 65 to about 70° C. In a certain embodiment, the second wax is an ester wax having an onset melting temperature of greater than about 55° C.

Any suitable or desired ester wax can be selected for embodiments herein, provided it has the desired peak melting temperature, low onset melting point characteristics, or combination thereof, described herein. In embodiments, the ester wax can be selected from the group consisting of montanic acid esters, ethylene glycol fatty acid esters, sorbitol fatty acid esters and polyoxyethylene fatty acid esters, higher fatty acid and higher alcohol esters, such as stearyl stearate and behenyl behenate; higher fatty acid and monovalent or multivalent lower alcohol esters, such as, butyl stearate, propyl oleate, glyceride monostearate, glyceride distearate and pentaerythritol tetra behenate; higher fatty acid and multivalent alcohol multimer esters, such as, diethyleneglycol monostearate, dipropyleneglycol distearate, diglyceryl distearate and triglyceryl tetrastearate; sorbitan higher fatty acid esters, such as, sorbitan monostearate and cholesterol higher fatty acid esters, such as, cholesteryl stearate, triacontanyl palmitate, Licowax F™ available from Clariant Corporation, MP-Wax S767, S792, S793, all available from Chukyo Yushi Co., Ltd.; Ester Wax E, Ester Wax E DAB, Ester Wax GE, Ester Wax ESL, Ester Wax EMS, Ester Wax LCP, Ester Wax LG, Ester Wax LGE, Ester Wax ELE, Ester Wax LA, Ester Wax E 50 all from Strohmeyer & Arpe, FINESTER 2860, FINESTER 2840, FINESTER 2240, FINESTER GMS 4654 V, FINESTER MG 9500, FINESTER MG 9000, FINESTER EG 1020, FINESTER EG 1018, all available from Fine Organics, and combinations thereof.

The second wax, in embodiments, the ester wax, can be provided in the toner in any suitable or desired amount. In embodiments, the second wax is provided in an amount of from about 1 to about 4, from about 2 to about 4, or from about 4 to about 8 percent by weight based upon the total weight of the toner composition.

In embodiments, the second wax is an ester wax having a carbon to oxygen ratio (C/O ratio) of from about 10 to about 40, or from about 0 to about 20, or from about 5 to about 50. In embodiments, the second wax is an ester wax having a carbon to oxygen ratio of less than about 50.

In embodiments, the first wax and the second wax each have an onset melting temperature of greater than about 55° C.

In addition to the first wax and second wax described above, the toner compositions can optionally contain one or more additional waxes. The optional additional wax can be included in the core, the shell, or both. The optional additional wax can include any of the various waxes conventionally used in emulsion aggregation toner compositions. Suitable examples of waxes include polyethylene, polypropylene, polyethylene/amide, polyethylenetetrafluoroethylene, and polyethylenetetrafluoroethylene/amide. Other examples include polyolefin waxes, such as polyethylene waxes, including linear polyethylene waxes and branched polyethylene waxes, and polypropylene waxes, including linear polypropylene waxes and branched polypropylene waxes; paraffin waxes, Fischer-Tropsch waxes, amine waxes; silicone waxes; mercapto waxes; polyester waxes; urethane waxes; modified polyolefin waxes (e.g., a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired, although crystalline waxes are preferred. By "crystalline polymeric waxes" it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer. In other embodiments, the toner does not contain any additional waxes other than the first wax and second wax described above.

To incorporate the wax into the toner, it is desirable for the wax to be in the form of one or more aqueous emulsions or dispersions of solid wax in water, where the solid wax particle size is usually in the range of from about 100 to about 500 nanometers.

If present, the toners may contain the optional additional wax in any suitable or desired amount, in embodiments, in an amount of from about 1 to about 13 percent, or from about 3 to about 15 percent, or from about 5 to about 11 percent, by weight of the toner, on a dry basis.

Polymeric Resin—Styrene, Acrylate, Styrene-Acrylate Copolymers.

The hybrid toner herein comprises an amorphous polyester resin and at least one resin comprising at least one of a styrene monomer, an acrylic acid monomer, an acrylic ester monomer, an acrylate, a styrene-acrylate copolymer, or a combination thereof, and an optional crystalline polyester. In embodiments, the toner resin comprises a first resin comprising an amorphous polyester resin and a second resin comprising a styrene-acrylate resin. In embodiments, the second resin comprises at least one of a styrene monomer, an acrylic acid monomer, an acrylic ester monomer, an acrylate, a styrene-acrylate copolymer, or a combination thereof. In embodiments, the optional crystalline polyester is provided in a reduced amount over previous toners, such as less than about 4 percent by weight based on the total weight of the toner. In embodiments, the toner herein is substantially free of crystalline polyester, in embodiments, completely free of crystalline polyester; that is, does not contain any crystalline polyester.

In embodiments, the toner comprises a core-shell configuration. In such embodiments, at least one of the core, the shell, or both comprises a first wax; a second wax that is different from the first wax; wherein the first wax comprises a paraffin wax having a peak melting point of from about 60 to about 80° C.; and wherein the second wax comprises an ester wax having a peak melting point of from about 60 to about 80° C., the core comprises an amorphous polyester resin and a resin comprising at least one of a styrene, an acrylate, a styrene-acrylate copolymer, or a combination thereof; and the shell comprises a resin comprising at least one of a styrene, an acrylate, or a styrene-acrylate copolymer.

The core resin and the shell resin can be the same or different. In embodiments, the toner comprises at least one styrene acrylate polymer resin. In embodiments, the toner comprises a core-shell configuration comprising at least one styrene acrylate polymer resin in the core, the shell, or both, wherein the styrene acrylate polymer resin is the same or different.

In embodiments, the core resin, the shell resin, or both, may be, independently, styrene-alkyl acrylate, more particularly a styrene-butyl acrylate polymer such as a styrene-butyl acrylate polymer.

In embodiments, the core comprises a styrene-acrylate resin and an amorphous polyester resin; and the shell comprises a styrene-acrylate resin.

In embodiments, the core resin, the shell resin, or both, each include a styrene monomer and an acrylic monomer. In embodiments, the core resin further comprises at least one cross-linker. In embodiments, the shell resin further comprises at least one cross-linker.

While unreacted monomer per se is not present in a polymer, for the purposes herein, a polymer is defined by the component monomers used to make that polymer. Hence, for example, a resin made from a styrene monomer and an acrylate monomer is said to be a styrene-acrylate resin.

In embodiments, the toner has a core-shell configuration; wherein the core comprises a first resin comprising an amorphous polyester resin and a second resin comprising a styrene-acrylate resin; and optionally, a colorant; and wherein the shell comprises a styrene-acrylate resin. In embodiments, the core is substantially free of polyester. In embodiments, the toner has a core-shell configuration, wherein the core comprises the first resin comprising an amorphous polyester resin and the second resin, wherein the second resin is a styrene-acrylate resin, and, optionally, a colorant; and wherein the shell comprises a styrene-acrylate resin. In embodiments, the core, the shell, or both the core and the shell comprise a paraffin wax having a peak melting point of less than about 80° C. In embodiments, the core, the shell, or both the core and the shell comprise an ester wax having a peak melting point of less than about 70° C.

As used herein, in embodiments, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

Illustrative examples of specific polymers for the toner, in embodiments, the core, the shell, or both, include, independently, poly(styrene-acrylic acid), polystyrene-alkyl acrylate), poly(styrene-alkyl methacrylate), poly(styrene-alkyl acrylate-acrylic acid), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methylmethacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and other similar polymers. The alkyl group in the aforementioned polymers may be any alkyl group, and in particular may be a $C_1$-$C_{12}$ alkyl group, for example, including methyl, ethyl, propyl, and butyl. As the aryl group, any aryl group known in the art may be used.

In embodiments, the styrene monomer is present in the core in an amount of from about 30 to about 90, or from about 70 to about 90 weight percent by weight of the core resin.

In embodiments, the acrylic ester monomer is present in the core in an amount of from about 10 to about 70, or from about 10 to about 30 weight percent by weight of the core resin.

In embodiments, the styrene monomer is present in the shell in an amount of from about 30 to about 90, or from about 70 to about 90 weight percent by weight of the shell.

In embodiments, the acrylic ester monomer is present in the shell in an amount of from about 10 to about 70, or from about 10 to about 30 weight percent by weight of the shell.

In embodiments, the core resin includes styrene and n-butyl acrylate.

In embodiments, the shell resin includes styrene and n-butyl acrylate.

In embodiments, the core resin may have a mean particle size of from about 100 nanometers (nm) to about 250 nm, or from about 100 nm to about 140 nm, or from about 140 nm to about 200 nm, or from about 140 to about 250 nm.

In embodiments, the shell resin may have a mean particle size of from about 100 nanometers (nm) to about 250 nm, or from about 100 nm to about 140 nm, or from about 140 nm to about 200 nm, or from about 140 to about 250 nm.

Amorphous Polyester Resin.

The toner compositions herein include an amorphous polyester resin. In embodiments, the toner compositions comprise a core-shell configuration including an amorphous polyester in the core, the shell or both. In embodiments, the toner compositions comprise a core-shell configuration including an amorphous polyester in the core only. That is, the shell is free of (does not contain) amorphous polyester.

The amorphous polyester resin may be formed by reacting a diol with a diacid in the presence of an optional catalyst. Examples of diacids or diesters including vinyl diacids or vinyl diesters used for the preparation of amorphous polyesters include dicarboxylic acids or diesters such as terephthalic acid, phthalic acid, isophthalic acid, fumaric acid, dimethyl fumarate, dimethyl itaconate, cis-1,4-diacetoxy-2-butene, diethyl fumarate, diethyl maleate, maleic acid, succinic acid, itaconic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethyl-isophthalate, diethylisophthalate, dimethylphthalate, phthalic anyhydride, diethylphthalate, dimethylsuccinate dimethylfumarate, dimethylmaleate, dimethylglutarate, dimethyladipate, dimethyl dodecylsuccinate, and combinations thereof. The organic diacid or diester may be present in any suitable or desired amount, in embodiments, in an amount of from about 40 to about 60 mole percent of the resin, or from about 42 to about 52 mole percent of the resin, or from about 45 to about 50 mole percent of the resin.

Examples of diols which may be used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The organic diol may be present in any suitable or desired amount, in embodiments, in an amount of from about 40 to about 60 mole percent of the resin, or from about 42 to about 55 mole percent of the resin, or from about 45 to about 53 mole percent of the resin.

Polycondensation catalysts which may be used in forming the amorphous polyester or the optional crystalline polyester include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in any suitable or desired amount, in embodiments, in an amount of from about 0.01 mole percent to about 4 mole percent based on the starting diacid or diester used to generate the polyester resin.

In embodiments, suitable amorphous resins include polyesters, polyamides, polyolefins, polyethylene, polybutylene, polyisobutyrate, ethylene-propylene copolymers, ethylene-vinyl acetate copolymers, polypropylene, combinations thereof, and the like.

Examples of amorphous resins which may be used include alkali sulfonated-polyester resins, branched alkali sulfonated-polyester resins, alkali-sulfonated-polyimide resins, and branched alkali sulfonated-polyimide resins. Alkali sulfonated polyester resins may be used, in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium, or potassium ion.

In embodiments, as noted above, an amorphous polyester resin is selected as a latex resin. Examples of such resins include those disclosed in U.S. Pat. No. 6,063,827, which is hereby incorporated by reference herein in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the formula

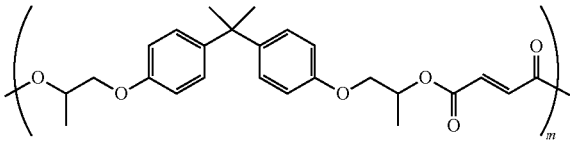

wherein m is from about 5 to about 1,000. Examples of such resins and processes for their production include those disclosed in U.S. Pat. No. 6,063,827.

An example of a linear propoxylated bisphenol A fumarate resin which may be used as a latex resin is available under the trade name SPARII from Resana S/A Industrias Quimicas, Sao Paulo, Brazil. Other propoxylated bisphenol A fumarate resins that may be used and are commercially available include GTUF and FPESL-2 from Kao Corporation, Japan, and EM181635 from Reichhold, Research Triangle Park, N.C., and the like.

Crystalline Polyester Resin.

In embodiments, the toner herein comprises a crystalline polyester resin. In embodiments, the crystalline resin is present in a reduced amount over prior toner compositions. In certain embodiments, the toner composition is free of, that is, does not contain crystalline resin.

The crystalline polyester resins, which are available from a number of sources, can be prepared by a polycondensation process by reacting an organic diol and an organic diacid in the presence of a polycondensation catalyst. Generally, a stoichiometric equimolar ratio of organic diol and organic diacid is used. However, in some instances, wherein the boiling point of the organic diol is from about 180° C. to about 230° C., an excess amount of diol can be used and removed during the polycondensation process. The amount of catalyst used varies, and can be selected in an amount, for example, of from about 0.01 to about 1 mole percent of the resin. Additionally, in place of the organic diacid, an organic diester can also be selected, where an alcohol by-product is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol is, for example, selected in an amount of from about 45 to about 50 mole percent of the resin, and the alkali sulfo-aliphatic diol can be selected in an amount of from about 1 to about 10 mole percent of the recent.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid, a diester or anhydride thereof; and an alkali sulfo-organic diacid such as the sodio, lithio, or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxyisophthalic acid, dialkyl-sulfo-benzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

There can be selected as a third latex a branched amorphous resin such as an alkali sulfonated polyester resin. Examples of suitable alkali sulfonated polyester resins include the metal or alkali salts of copoly(ethylene-terephthalate)-copoly-(ethylene-5-sulfo-isophthalate), copoly (propylene-terephthalate)-copoly(propylene-5-sulfo-isophthalate), copoly(diethylene-terephthalate)-copoly (diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium, or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-co-poly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(oxylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium, or potassium, and the like. In embodiments, the alkali metal is lithium.

The crystalline resin may be present in any suitable or desired amount, in embodiments, in an amount of from about 5 to about 50 percent, or from about 10 to about 35 percent by weight of the toner composition.

In certain embodiments, the toner herein comprises a crystalline polyester resin in a reduced amount over prior toners, in embodiments, in an amount of from about 0 to about 4, or from about 2 to about 6, or from about 1 to about 5 percent by weight based upon the total weight of the toner composition. In certain embodiments, the toner comprises crystalline polyester in an amount of greater than zero to less than about 4 percent by weight based upon the total weight of the toner composition.

In embodiments, the toner is free of, that is, does not contain any crystalline polyester resin. In embodiments, the toner comprises a core-shell configuration wherein both the core and the shell are free of crystalline polyester resin.

In embodiments, the toner comprises a core-shell configuration wherein the core, the shell, or both the core and shell comprise crystalline polyester in a reduced amount of from about 0 to about 4, or from about 2 to about 6, or from about 1 to about 5 percent by weight, in embodiments, in an amount of greater than zero to less than about 4 percent by weight based upon the total weight of the toner composition. In certain embodiments, the core is free of crystalline polyester resin.

The crystalline resin can possess various melting points, of, for example, from about 30° C. to about 120° C., or from about 50° C. to about 90° C. The crystalline resin may have a number average molecular weight (Mn), as measured by gel permeation chromatography (GPC) of, for example, from about 1,000 to about 50,000, or from about 2,000 to about 25,000, and a weight average molecular weight (Mw) of, for example, from about 2,000 to about 100,000, or from about 3,000 to about 80,000, as determined by Gel Permeation Chromatography using polystyrene standards. The molecular weight distribution (Mw/Mn) of the crystalline resin may be, for example, from about 2 to about 6, or from about 3 to about 4.

In embodiments, the crystalline polyester has an onset melting temperature of greater than about 55° C. and an offset melting temperature of less than about 80° C., such that only a single peak is observed in the MDSC of the toner.

Optional Additives.

The toner particles can also contain other optional additives as desired. For example, the toner can include positive or negative charge control agents in any desired or effective amount, in embodiments, in an amount of at least about 0.1 percent by weight of the toner, or at least about 1 percent by weight or the toner, or no more than about 10 percent by weight of the toner, or no more than about 3 percent by weight of the toner. Examples of suitable charge control agents include, but are not limited to, quaternary ammonium compounds such as alkyl pyridinium halides, bisulfates, alkyl pyridinium compounds, including those disclosed in U.S. Pat. No. 4,298,672, which is hereby incorporated by reference herein in its entirety; organic sulfate and sulfonate compositions, including those disclosed in U.S. Pat. No. 4,338,390, which is hereby incorporated by reference herein in its entirety; cetylpyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in embodiments, in an amount of at least about 0.1 percent by weight of the toner, or at least about 0.25 percent by weight of the toner, or no more than about 5 percent by weight of the toner, or no more than about 3 percent by weight of the toner. Suitable additives include, but are not limited to, those disclosed in U.S. Pat. Nos. 3,590,000 and 6,214,507, each of which are hereby incorporated by reference herein in their entireties. These additives can be applied simultaneously with the shell resin or after application of the shell resin.

Colorant.

The toners may optionally contain a colorant. Any suitable or desired colorant can be selected. In embodiments, the colorant can be a pigment, a dye, mixtures of pigments and dyes, mixtures of pigments, mixtures of dyes, and the like. For simplicity, the term "colorant" when used herein is meant to encompass such colorants, dyes, pigments, and mixtures unless specified as a particular pigment or other colorant component. In embodiments, the colorant comprises a pigment, a dye, mixtures thereof, in embodiments, carbon black, magnetite, black, cyan, magenta, yellow, red, green, blue, brown, mixtures thereof, in an amount of from about 1 percent to about 25 percent by weight based upon the total weight of the toner composition. It is to be understood that other useful colorants will become readily apparent based on the present disclosure.

Useful colorants include Paliogen® Violet 5100 and 5890 (BASF), Normandy Magenta RD-2400 (Paul Uhlrich), Permanent Violet VT2645 (Paul Uhlrich), Heliogen® Green L8730 (BASF), Argyle Green XP-111-S (Paul Uhlrich), Brilliant Green Toner GR 0991 (Paul Uhlrich), Lithol® Scarlet D3700 (BASF), Toluidine Red (Aldrich), Scarlet for Thermoplast NSD Red (Aldrich), Lithol® Rubine Toner (Paul Uhlrich), Lithol® Scarlet 4440, NBD 3700 (BASF), Bon Red C (Dominion Color), Royal Brilliant Red RD-8192 (Paul Uhlrich), Oracet® Pink RF (Ciba Geigy), Paliogen® Red 3340 and 3871K (BASF), Lithol® Fast Scarlet L4300 (BASF), Heliogen® Blue D6840, D7080, K7090, K6910, and L7020 (BASF), Sudan Blue OS (BASF), Neopen® Blue FF4012 (BASF), PV Fast Blue B2G01 (American Hoechst), Irgalite® Blue BCA (Ciba Geigy), Paliogen® Blue6470 (BASF), Sudan II, III, and IV (Matheson, Coleman, Bell), Sudan Orange (Aldrich), Sudan Orane 220 (BASF), Paliogen® Orange 3040 (BASF), Ortho Orange OR 2673 (Paul Uhlrich), Paliogen® Yellow 152 and 1560 (BASF), Lithol® Fast Yellow 0991K (BASF), Paliotol® Yellow 1840 (BASF), Novaperm® Yellow FGL (Hoechst), Permanent Yellow YE 0305 (Paul Uhlrich), Lumogen® Yellow 00790 (BASF), Suco-Gelb 1250 (BASF), Suco-Yellow D1355 (BASF), Suco Fast Yellow D1165, D1355, and D1351 (BASF), Hostaperm® Pink E (Hoechst), Fanal® Pink D4830 (BASF), Cinquasia® Magenta (DuPont), Paliogen® BlackL9984 (BASF), Pigment Black K801 (BASF), and particularly carbon blacks such as REGAL® 330 (Cabot), Carbon Black 5250 and 5750 (Columbian Chemicals), and the like, or mixtures thereof.

Additional useful colorants include pigments in water based dispersions such as those commercially available from Sun Chemical, for example, SUNSPERSE® BHD 6011X (Blue 15 Type), SUNSPERSE® BHD 9312X (Pigment Blue 15 74160), SUNSPERSE® BHD 6000X (Pigment Blue 15:3 74160), SUNSPERSE® GHD 9600X and GHD 6004X (Pigment Green 7 74260), SUNSPERSE® QHD 6040 X (Pigment Red 122 73915), SUNSPERSE® RHD 9668X (Pigment Red 185 12516), SUNSPERSE® RHD 9365X and 9504X (Pigment Red 57 15850:1), SUNSPERSE® YHD 6005X (Pigment Yellow 83 21108), FLEXIVERSE® YFD 4249 (Pigment Yellow 17 21105), SUNSPERSE® YHD 6020X and 6045X (Pigment Yellow 74 11741), SUNSPERSE® YHD 600X and 9604X (Pigment Yellow 14 21095), FLEXIVERSE® LFD 4343 and LFD 9736 (Pigment Black 7 77226), and the like, or mixtures thereof. Other useful water based colorant dispersions include those commercially available from Clariant, for example, HOSTAFINE® Yellow GR, HOSTAFINE® Black T and Black TS, HOSTAFINE® Blue B2G, HOSTAFINE® Rubine F6B, and magenta dry pigment such as Toner Magenta 6BVP2213 and Toner Magenta EO2 which can be dispersed in water and/or surfactant prior to use.

Other useful colorants include magnetites, such as Mobay magnetites M08029, M98960, Columbian magnetites, MAPICO® BLACKS, and surface treated magnetites; Pfizer magnetites CB4799, CB5300, CB5600, MXC6369, Bayer magnetites, BAYFERROX® 8600, 8610; Northern Pigments magnetites, NP-604, NP-608; Magnox magnetites TMB-100 or TMB-104; and the like or mixtures thereof. Additional examples of pigments include phthalocyanine HELIOGEN® BLUE L6900, D6840, D7080, D7020, PYLAM® OIL BLUE, PYLAM® OIL YELLOW, PIGMENT BLUE 1 available from Paul Uhlrich & Company, Inc., PIGMENT VIOLET 1, PIGMENT RED 48, LEMON CHROME YELLOW DCC 1026, ED. TOLUIDINE RED, AND BON RED C available from Dominion Color Corporation, Ltd., Toronto, Ontario, NOVAPERM® YELLOW FGL, HOSTAPERM® PINK E from Hoechst, and CINQUASIA® MAGENTA (DuPont), and the like. Examples of magentas include 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Examples of cyans include copper tetra(octadecyl sulfonamide) phthalocyanine, x-copper phthalocyanine pigment listed in the Color Index as CI 74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index ad CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,4-dimethoxy acetoacetanilide, and Permanent Yellow FGL. Colored magnetites, such as mixtures of MAPICO® BLACK and cyan components may also be selected as pigments.

The colorant, such as carbon black, cyan, magenta, and/or yellow colorant, is incorporated in an amount sufficient to impart the desired color to the toner. In general, pigment or dye is employed in an amount of from about 1 percent to about 35 percent, or from about 5 percent to about 25 percent, or from about 5 percent to about 15 percent, by weight of the toner particles on a solids basis. However, amounts outside of these ranges can also be used.

As described hereinabove, certain current hybrid toner technology is desired to provide a very large cost-down for replacement of more expensive toner. Certain of these toners are comprised of polyester amorphous latex, polyester crystalline latex, and styrene/acrylate polymer latex, and a shell of styrene/acrylate polymer latex. However, because in certain toners, the carbon black does not disperse into the styrene/acrylate resin portion in the presence of the polyester, or preferentially ends up at the interfaces of the styrene/acrylate and polyester, the carbon black dispersion can be much worse than in a standard toner comprising only polyester resins. This poor dispersion can lead to high dielectric loss, which in turn is known to lead to poor transfer efficiency in the printer and in some cases lower charge as well. In embodiments, a hybrid toner is provided herein which provides a solution for hybrid toner dielectric loss.

In hybrid toners comprised of styrene/acrylate latex added into the core, the carbon black can disperse preferentially in the polyester. Since there is less polyester due to the replacement with styrene/acrylate, this can result in the phenomenon where the local concentration of the carbon black is increased, which increases the chance that carbon black particles are in contact, which increases the conductivity of the toner as measured by dielectric loss. Just using the very pure carbon black is insufficient to provide sufficiently low dielectric loss. U.S. Pat. No. 8,691,488, which is hereby incorporated by reference herein in its entirety, describes reducing the coalescence temperature to reduce dielectric loss further at least in polyester toners without any styrene-acrylate even with very high loadings of carbon black such as in hyperpigmented toners. However, in certain hybrid toners lowering coalescence temperature can make it difficult to fully coalesce the styrene-acrylate shell, and the fuser hot offset temperature can degrade due to less wax on the surface, particularly when the amount of wax in the toner is reduced to reduce cost. Thus, there is a need for a reduction in the dielectric loss for the hybrid toner compositions.

In embodiments, a styrene/acrylate polyester hybrid toner composition that provides low dielectric loss for black toner with excellent fusing and blocking is provided by using a wax with a peak melting point below 80° C., but with an onset of melting greater than 50° C., where the crystalline polyester also has a melt point less than 80° C., and the difference between the wax peak melting point and the crystalline polyester peak melting point is less than or equal to about 10° C., where the styrene-acrylate resin has a Tg onset of about 50 to 56° C., and where the pigment dispersant is comprised of a naphthalene sulphonic acid polymeric surfactant.

In embodiments, the hybrid toner herein comprises a crystalline polyester having a peak melting point of less than about 80° C.; wherein the difference between the peak melting point of the crystalline polyester and the peak melting point of the paraffin wax is less than about 15° C.; and wherein the difference between the peak melting point of the crystalline polyester and the peak melting point of the ester wax is less than about 15° C.

In embodiments, the hybrid toner comprises a core-shell structure, wherein the core, the shell, or both the core and the shell comprise a paraffin wax having a peak melting point of less than about 80° C.

In embodiments, the hybrid toner comprises a core-shell structure, wherein the core, the shell, or both the core and the shell comprise an ester wax having a peak melting point of less than about 70° C.

In embodiments, a hybrid emulsion/aggregation black toner composition herein comprises: a) a shell resin comprising a styrene-acrylate, and a core resin comprising a styrene-acrylate, an amorphous polyester, an optional crystalline polyester, and carbon black;

b) the core, the shell, or both core and shell comprise a wax that has a peak melting point that is less than 80° C.;

c) the wax has an onset of melting temperature that is greater than or equal to 50° C.;

d) the crystalline polyester has a peak melting point that is less than 80° C.;

e) the difference between the wax peak melting point and the crystalline polyester peak melting point is less than or equal to 15° C.;

f) the styrene acrylate resin has a 2nd onset Tg of from about 50° C. to about 56° C.;

g) a pigment dispersant comprising naphthalene sulphonic acid polymeric surfactant; and h) wherein the toner has low a dielectric loss of less than 65.

As shown in Table 2 below, certain emulsion aggregation toner uses a polyethylene wax, such as a dispersion provided by IGI. The melt point of this wax, the peak of the melting curve in the $2^{nd}$ scan DSC, was 91.6° C. The onset of melting of this wax is about 60° C. In other embodiments, a paraffin wax, having a melting point of about 77° C. can be selected.

In embodiments, the toner includes a carbon black colorant. Certain emulsion aggregation toners include NIPex® 35 a non-oxidized, low structure furnace black, while other emulsion aggregation toners use Regal® 330. In order to enable as low as possible dielectric loss, a low conductivity carbon black such as the NIPex® 35 is selected. Since carbon black is a semi-conductor, it is desirable to keep the carbon black as pure as possible. Heteroatoms such as oxygen and sulfur dope the carbon black semi-conductor, increasing the conductivity. NIPex® 35 has very high carbon content on the surface as determined by XPS, >99.5%, and very low At % of O and S, <0.5% total. Since the carbon black is very pure, and has very little of the very strong dopants oxygen and sulfur on the surface, the conductivity is very low. This provides lower dielectric loss than with a less pure carbon black, such as Regal® 330, which has >1% oxygen and sulfur. The difference in the purity is most dramatically shown by the carbon:oxygen ratio of the carbon black, which is 499:1 for NIPex® 35, compared to 139:1 for Regal® 330.

TABLE 1

| Sample | At % C | At % O | At % S | Carbon:Oxygen Ratio |
|---|---|---|---|---|
| Regal ® 330 | 98.90 | 0.71 | 0.39 | 139:1 |
| NIPex ® 35 | 99.76 | 0.20 | 0.04 | 499:1 |

Emulsion aggregation polyester toners commonly employ about 7.2 parts per hundred (pph) TaycaPower B2060 surfactant, a sodium salt of dodecylbenzene sulphonate as the dispersant for NIPex® carbon black dispersion in the toner.

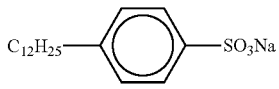

TaycaPower BN2060
Na salt of DBS

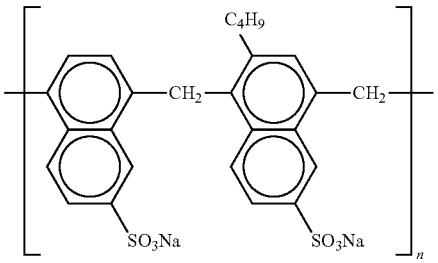

Demol SN-B

In embodiments, the amount of TaycaPower surfactant can be reduced in the pigment dispersion to only 2 pph, while adding 3.2 pph of DEMOL SN-B, which is a polymeric surfactant of butyl naphthalene sulfonic acid/2-naphthalene sulfonic acid/formaldehyde, sodium salt (Kao Corporation). The dispersion can then be used in making the hybrid toners herein having improved dielectric loss performance.

Similar products can be used to reduce dielectric loss. For example: DEMOL M, a sodium arylsulfonate formaldehyde condensate powder, DEMOL SS-L, a sodium arylsulfonate formaldehyde condensate, DEMOL N, DEMOL RN, DEMOL T and DEMOL T-45 sodium naphthalene sulfonate formaldehyde condensates powder, DEMOL NL a sodium naphthalene sulfonate formaldehyde condensates liquid. Other manufacturers provide similar sulphonate formaldehyde condensates such as 1-Naphthalenesulfonic acid, formaldehyde polymer, sodium salt CAS NO. 32844-36-3 available from Anyang Double Circle Auxiliary Co., LTD (China) and sodium naphthalene sulfonate formaldehyde CAS NO. 9084-06-4 available from Chemtrade International (China).

Coagulant.

The toners herein may also contain a coagulant, such as a monovalent metal coagulant, a divalent metal coagulant, a polyion coagulant, or the like. A variety of coagulants are known in the art. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds, in embodiments, may have from about 2 to about 13, or from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from about 0 to about 5 percent, or from about greater than 0 to about 3 percent, by weight of the toner particles.

Surfactant.

In preparing the toner by the emulsion aggregation procedure, one or more surfactants may be used in the process. Suitable surfactants include anionic, cationic, and non-ionic surfactants. In embodiments, the use of anionic and non-ionic surfactants are preferred to help stabilize the aggregation process in the presence of the coagulant, which other could lead to aggregation instability.

Anionic surfactants include sodium dodecylsulfate (SDS), sodium dodecyl benzene sulfonate, sodium dodecylnaphthalene sulfate, dialkyl benzenealkyl sulfates and sulfonates, abietic acid, and the NEOGEN® brand of anionic surfactants. An example of a suitable anionic surfactant is NEOGEN® RK available from Daiichi Kogyo Seiyaku co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, ethyl pyridinium bromide, C12, C15, C17 trimethyl ammonium bromides, halide salts of quaternized polyoxyethylalkylamines, dodecyl benzyl triethyl ammonium chloride. MIRAPOL® and ALKAQUAT® available from Alkaril Chemical Company, SANISOL® (benzalkonium chloride) available from Kao Chemicals, and the like. An example of a suitable cationic surfactant is SANISOL® B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxytheylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL® CA-210, IGEPAL® CA-520, IGEPAL® CA-720, IGEPAL® CO-890, IGEPAL® CO-720, IGEPAL® CO-290, IGEPAL® CA-210, ANTAROX® 890 and ANTAROX® 897. An example of a suitable nonionic surfactant is ANTAROX® 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide, and the like, among others.

Examples of the acids that can be used include, for example, nitric acid, sulfuric acid, hydrochloric acid, acetic acid, citric acid, trifluro acetic acid, succinic acid, salicylic acid, and the like, and which acids are, in embodiments, used in a diluted form in the range of about 0.5 to about 10 weight percent by weight of water, or in the range of about 0.7 to about 5 weight percent by weight of water.

In embodiments, a naphthalene sulphonic acid polymeric surfactant is selected.

Beta-Carboxyethyl Acrylate.

Previously, styrene/acrylate latex used in certain Xerox® emulsion aggregation toners incorporated beta-CEA (beta-carboxyethyl acrylate, or IUPAC: 3-(prop-2-enoyloxy)propanoic acid) of the formula

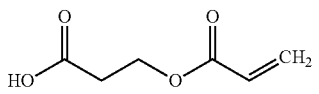

into the resin latex at a 3 pph level relative to styrene/acrylate. In embodiments, to control the Tg of the resin, the weight ratio of the styrene to the acrylate monomer can be adjusted. To that mixture, the amount of beta-CEA monomer added is separately controlled, in embodiments 3 pph of beta-CEA is added with respect to the total weight of styrene and acrylate monomer, followed by polymerization to form the latex by emulsion polymerization.

The beta-CEA can be added to enable the emulsion aggregation process. In some previous embodiments, hybrid toners comprising styrene/acrylate resin latex and polyester latex (typically both an amorphous and a crystalline polyester), with styrene/acrylate latex used as the shell, the beta-CEA has been used at 3 pph.

The toners of the present disclosure include a reduced amount of beta-CEA from prior 3 pph in the shell styrene/acrylate latex to optimize the hybrid toner process. Without wishing to be bound by theory, it is believed that incorporated beta-CEA resin in very low amounts in the styrene/acrylate shell latex improves the resin flow dramatically in emulsion aggregation toner coalescence. Without at least a little beta-CEA the toner process can be uncontrollable, resulting in poor particle properties—size, GSD, fines, and coarse. Using the prior 3 pph, the coalescence can be too slow for the styrene/acrylate shell latex.

In embodiments, the present toners include styrene/acrylate latex with beta-CEA in an amount of less than 3 pph. In embodiments, the present toners include styrene/acrylate latex with beta-CEA in an amount of from about 0.03 to less than 3 pph, or from about 1 to about 2 pph, or from about 0.5 to about 2 pph. In embodiments, the present toners include beta-CEA in an amount of from about 1 pph to about 2 pph beta-CEA in the shell styrene/acrylate latex.

In embodiments, the core styrene/acrylate latex contains about 3 pph beta-CEA, as the styrene/acrylate latex in the core tends to slow down the coalescence in the core, which is fast due to the presence of polyester in the core. Thus, to avoid over spherodization of the core it is not desirable to improve the flow of the styrene/acrylate latex in the core. Thus, in embodiments, the present toners include styrene/acrylate latex with beta-CEA in a reduced amount as described above in the shell, in embodiments, in an amount of less than 3 pph, in embodiments, in an amount of be about 1 pph to about 2 pph beta-CEA in the shell latex in combination with a lesser amount in the core, such as from about 0.03 to about 5 pph, or from about 0.1 to about 0.5 pph.

The small amounts of β-CEA (i.e., from about 0.05 pph to about 2.5 pph) present in the shell is beneficial for the EA process helping to improve the resin flow in the toner coalescence. Without the presence of β-CEA in the shell may result in poor toner particle properties with respect to size, the geometric standard deviation (GSD), fines, and coarse. With more than 2.5 pph of β-CEA present in the shell may cause the coalescence process to be too slow for the shell latex resulting in poor toner particle properties, such as a rough and incomplete shell that does not encompass the entire toner particle.

In embodiments, the amount of β-CEA present in the second resin in the shell may be from about 1 pph to about 2 pph, from about 0.3 pph to about 1.7 pph, or from about 0.5 pph to about 1.5 pph by weight of the second resin.

In embodiments, the amount of β-CEA present in the first resin in the core may be from about 0 pph to about 10 pph of β-CEA by weight of the first resin, such as from about 3 pph to about 10 pph, from about 3 pph to about 8 pph, or from about 3 pph to about 5 pph by weight of the first resin. In one embodiment, no β-CEA is present in the first resin. The first resin may contain a lower amount of β-CEA, such as less than 3 pph by weight of the first resin, or having the same β-CEA content as in the second resin, or a higher β-CEA amount than that in the second resin. However, to avoid over spherodization of the core, it may not be desirable to improve the flow of the core latex in the core by lowering the amount of β-CEA present in the core. For example if the Tg and molecular weight of the first resin in the core is relatively low, lower β-CEA in the core may result in overspherodization of the core of the toner for embodiments where a non-spherical toner is desired. The term "spherodization" means that the overall toner particle circularity increases. It is desired that the circularity can be controlled, in embodiments within the range of about 0.93 and about 0.99. However, if the coalescence of the core is too rapid, then the circularity of the toner particle may not be easily controlled as it grows too rapidly. In a production scale, it is desirable that the target circularity of the toner particle to be reached within the time frame of from about 90 minutes to about 4 hours. If the coalescence process is faster than 90 minutes it may be difficult to monitor and stop the circularity increase. On the other hand, if the coalescence process is longer than 4 hours, then toner production throughput may suffer.

In embodiments, the amount of β-CEA in the first resin is higher than the amount of β-CEA in the second resin. In embodiments, the amount of β-CEA in the first resin is lower than the amount of β-CEA in the second resin.

Process.

The toners herein can be prepared by any suitable or desired process. In embodiments, a process for preparing a hybrid toner composition comprises mixing a latex resin comprising an amorphous polyester and at least one of a styrene, an acrylate, or a combination thereof, an optional crystalline polyester latex, an optional colorant, a first wax, and a second wax that is different from the first wax; wherein the first wax comprises a paraffin wax having a peak melting point of from about 60 to about 80° C.; wherein the second wax comprises an ester wax having a peak melting point of from about 60 to about 80° C.; optionally, adding a coagulant to the mixture; heating the mixture to a temperature below the glass transition temperature of the latex resin or at least one of the latex resins to form aggregated particles; heating the mixture to a temperature above the glass transition temperature of the latex resin or at least one of the latex resins to coalesce the aggregated particles; and optionally isolating the toner particles.

In embodiments, a toner composition herein comprises a core-shell configuration and a process for preparing the hybrid toner having a core and a shell, comprises mixing a first latex resin comprising an amorphous polyester and at least one of a styrene, an acrylate, or a combination thereof, an optional crystalline polyester latex, an optional colorant, a first wax, and a second wax that is different from the first wax; wherein the first wax comprises a paraffin wax having a peak melting point of from about 60 to about 80° C.; wherein the second wax comprises an ester wax having a peak melting point of from about 60 to about 80° C.; to form a core mixture; optionally, adding a coagulant to the core mixture; heating the core mixture to a temperature below the glass transition temperature of the first latex resin to aggregate the core mixture to form aggregated core particles; mixing a second latex resin comprising at least one styrene-acrylate resin and a coalescent agent to form a shell mixture; coating the shell mixture onto the aggregated core particles; heating the shell mixture and the aggregated core particles to a temperature above the glass transition temperature of the second latex resin to coalesce the aggregated core particles to form toner particles; and optionally, isolating the toner particles.

Thus, the process herein may be an emulsion aggregation process for forming the emulsion aggregation toner particles. The process may include aggregating an emulsion containing polymer binder (that is, a first latex including an amorphous polyester and at least one of a styrene, an acrylate, or a combination thereof, an optional crystalline polyester latex), an optional colorant, a first wax, and a second wax that is different from the first wax, an optional surfactant, an optional coagulant, and any optional additives to form aggregates of core particles, and subsequently preparing a shell mixture which includes mixing the desired coalescent agent and a second latex to form a shell mixture; coating the shell mixture onto the aggregated core particles, subsequently coalescing or fusing the aggregates, and then recovering, optionally washing, optionally cooling, optionally drying, the obtained emulsion aggregation toner particles, and optionally isolating the toner particles.

In embodiments, the mixing of the first latex, the first and second waxes, optional colorant, and optional coagulant, results in a core mixture having a pH of, for example, about 2.0 to about 4.0, which is aggregated by heating to a temperature below the polymer Tg to provide toner size aggregates. In embodiments, the heating of the core mixture may be conducted at a temperature of from about 40 to about 60° C., or from about 45 to about 50° C., or from about 40 to about 55° C. In embodiments, the core mixture may be heated for from about 15 minutes to about 120 minutes, or from about 15 minutes to about 60 minutes, or from about 15 minutes to about 30 minutes.

A second latex may then be mixed with a coalescent agent to form a shell mixture. The pH of the shell mixture may then be adjusted, for example by the addition of a base, such as sodium hydroxide solution or the like, until a pH of about 6.5 to about 8.0 is achieved. The resulting shell mixture may be coated onto the surface of the aggregated core particles thus providing a shell over the formed aggregates. Subsequently, the shell mixture and the aggregated core particles may be heated to a temperature above the glass transition of any of the shell resin polymers, such as the at least one styrene-acrylate resin, to coalesce the aggregated core particles to form toner particles. In embodiments, the heating of the shell mixture and the aggregated core particles may be conducted at a temperature of from about 65 to about 90° C., or from about 70 to about 85° C., or from about 75 to about 85° C.

In embodiments, the shell mixture and the aggregated core particles may be heated for from about 15 minutes to about 480 minutes, or from about 30 minutes to about 360 minutes, or from about 90 minutes to about 480 minutes.

The fused particles can be measured for shape factor or circularity, such as with a Sysmex FPIA 3000 analyzer, until the desired shape is achieved.

The resulting toner particles may be allowed to cool to room temperature (about 20° C. to about 25° C.) which may be rapidly cooled by using a quenching technique well known in the art, and are optionally washed to remove any additive or surfactant. The toner particles are then optionally dried.

In embodiments, the toner of the present disclosure can be made to have the following physical properties when no external additives are present on the toner particles.

The toner particles can have a surface area, as measured by the BET method, of about 1.3 to about 6.5 $m^2/g$. For example, for cyan, yellow, and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a low number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, or from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, or about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular basis. This is a faster method to quantify the particle shape. The instrument used is an FPIA 3000 manufactured by Sysmex. For a completely circular sphere the circularity would be 1.000. In embodiments, the toner particles can have a circularity of about 0.920 to about 0.990, or from about 0.940 to about 0.980.

In addition, the toner particles of the present disclosure have, in embodiments, the following rheological and flow properties. First, the toner particles can have the following molecular weight values, each as determined by gel permeation chromatography (GPC) as known in the art. The binder of the toner particles can have a weight average molecular weight, Mw, of from about 15,000 daltons to about 90,000 daltons.

Overall, the toner particles, in embodiments, have a weight average molecular weight (Mw) in the range of about 17,000 to about 60,000 daltons, a number average molecular weight (Mn) of about 9,000 to about 18,000 daltons, and a MWD of about 2.1 to about 10. MWD is a ratio of the Mw to Mn of the toner particles, and is a measure of the polydispersity, or width, of the polymer. For cyan and yellow toners, the toner particles, in embodiments, can exhibit a weight average molecular weight (Mw) of about 22,000 to about 45,000 daltons, a number average molecular weight (Mn) of about 9,000 to about 13,000 daltons, and a MWD of about 2.2 to about 10. For black and magenta, the toner particles, in embodiments, can exhibit a weight average molecular weight (Mw) of about 22,000 to about 45,000 daltons, a number average molecular weight (Mn) of about 9,000 to about 13,000 daltons, and a MWD of about 2.2 to about 10.

Melting Peak.

In embodiments, the hybrid toner herein shows a single endothermic melting peak in the first scan measured by modulated differential scanning calorimetry (MDSC). In embodiments, the heat of fusion of the single endothermic melting peak is greater than or equal to 5 joule/gram (J/g).

Gloss.

In embodiments, the toner here have reduced gloss as compared to comparable toners having the traditional, greater amount of crystalline polyester resin.

In embodiments, a paraffin wax having a melting point of 74.8° C. is selected.

In embodiments, an ester wax selected for the present hybrid toner is S-973 ester wax, available from Chukyo Yushi Co., Ltd., which has a melting point of 65.7° C. All values are from the $2^{nd}$ heat modulated differential scanning calorimetry (MDSC) total heat flow.

TABLE 2

| Wax Chemical Class | Onset of Melting 2nd Scan (° C.) | Peak Melting 2nd Scan (° C.) | Heat of Fusion | C/O Ratio |
|---|---|---|---|---|
| Paraffin Wax | About 60 | 74.8 | 209.5 | 129 |
| Ester Wax | About 50 | 65.7 | 256.8 | 14 |

EXAMPLES

The following Examples are being submitted to further define various species of the present disclosure. These Examples are intended to be illustrative only and are not intended to limit the scope of the present disclosure. Also, parts and percentages are by weight unless otherwise indicated.

A series of toners were prepared as shown in Table 3 (Comparative Examples) and Table 4 (Examples). The general process for preparing the hybrid toner, the carbon black pigment Nipex® dispersion, and the styrene-acrylate latex used in the examples below is described in U.S. patent application Ser. No. 15/187,475, which is hereby incorporated by reference herein in its entirety.

NIPEX® Pigment Dispersions. In the hybrid toners, either a NIPEX® 35 pigment dispersion prepared with 7.2 pph TaycaPower (calculated based on % solids of dispersant to pigment, TaycaPower is 60% active ingredient solids/40% water) was used, or a dispersion of NIPEX® 35 with a mixture of both 2 pph TaycaPower and 3.2 pph Demol SN-B (all calculated based on wt % solids of dispersant to pigment, where TaycaPower is 60% active ingredient solids/40% water). For the TaycaPower BN2060/Demol SN-B dispersion with 2 pph TaycaPower and 3.2 pph of Demol SN-B, a total of 1140 g of dispersion was prepared at a solids content of 20.83% in a Rannie 2000 homogenizer. The final particle size was 150 nm and was very stable with no settling overnight. The homogenizer run was 0.5 hours at low pressure of 2000 psi as a pre-homogenizing step and 3.5 hours at high pressure of 20,000 psi.

A 100-gal styrene-acrylate latex emulsion, latex C, comprised of polymer particles generated from the emulsion polymerization of 81 wt % styrene, 19 wt % n-butyl acrylate, 1.5 pph beta-carboxyethyl acrylate 03-CEA) and 0.35 pph ADOD was prepared as follows:

Calfax Surfactant Solution Preparation: A surfactant solution of 0.334 kilograms Calfax® DB-45 (anionic emulsifier; sodium dodecyl diphenyl oxide disulfonate, 45 percent active, available from Pilot Chemical Company) and 87.23 kilograms deionized water was charged into a stainless steel 100-gal capacity reactor and mixed at 110 rpm. The reactor was equipped with a condenser and purged with nitrogen at 10 Standard Cubic Feet per Hour (SCFH VAPOR) while being heated up to 75° C. at a controlled rate and held there.

Emulsified Monomer Preparation: Separately in 45 gal plastic drum, 1.89 kilograms Calfax® DB-45 and 46.73 kilograms deionized water were mixed together as the surfactant solution. Separately in a 50-gal capacity reactor, the monomer emulsion was prepared as followed: 81.1 kg of styrene, 19.02 kg of butyl acrylate, 1.05 kg of β-CEA, 1.37 kg of 1-dodecanethiol (DDT) and 0.350 kg of 1,10-decanediol diacrylate (ADOD). The surfactant solution was then transferred to the 50-gal capacity reactor containing the monomer emulsion by vacuum while being stirred at 150 rpm. The surfactant solution and monomer emulsion were mixed for 5 minutes followed by no mixing for 3 minutes; this "mix/sit" step was repeated two times to create an emulsified aqueous monomer solution.

Separately in a 5-gallon pail, 1.50 kilograms of ammonium persulfate initiator was dissolved in 13.91 kilograms of deionized water.

Into the 100-gal reactor containing the heated Calfax surfactant solution was added 7.60 kg (5% seed) of the emulsified monomer to form the "seeds". After 20 minutes, the initiator solution addition was started and charged into the reactor over 23.5 minutes. This was chased with 1.0 kg of deionized water.

Monomer Feed Reaction: After 20 minutes, the remaining monomer emulsion was added into the 100-gal reactor over two aliquots. Feed #1 was added into reactor over 120 minutes and equated to 72.2 kg of emulsified monomer followed by 1.2 kg of deionized water "chase". To the remaining monomer emulsion (feed #2) was added 0.63 kg 1-dodecanethiol (DDT) and fed into the reactor over 90 minutes. At this point the rpm was increased to 120 and an extra 2.3 kg of deionized water "chase" was added to reactor to clear emulsified monomer from pump lines. The reactor was held at 75° C. for 60 minutes. The condenser was turned off after 1 hour post reaction while still at 75° C. and excess monomer was allowed to blow out of reactor for 120 minutes before cooling to room temperature. The white non-viscous liquid was then discharged into two closed head plastic drums once the temperature plateaued to room temperature.

The particle size was then measured by Nanotrac® U2275E particle size analyzer. Narrow particle size was achieved with a Particle Size=188 nm±60 nm. The second onset Tg=55.3° C. by DSC, and the latex Mw=24.5 kilodaltons and Mn=8.97 kilodaltons measured with a Waters® ACQUITY® Advanced Polymer Chromatography™ (APC™) System and using polystyrene standards.

Preparation of Hybrid Toner. Comparative Example I

To the 2 L glass reactor was added 96.35 grams of amorphous polyester emulsion A (having an Mw of about 19,400, an Mn of about 5,000, a Tg onset of about 60° C., and about 35% solids), 95.73 grams of amorphous polyester emulsion B (having an average molecular weight (Mw) of about 86,000, a number average molecular weight (Mn) of about 5,600, an onset glass transition temperature (Tg onset) of about 56° C., and about 35% solids), 80.88 grams of styrene-acrylate latex emulsion C, 31.52 grams of crystalline C12C6 (comprised of the monomers of dodecandioic acid and hexanediol) polyester emulsion D (having an Mw of about 23,300, an Mn of about 10,500, a melting temperature of about 71° C. and about 35.4% solids), 10.46 grams of cyan pigment (PB15:3), 55.10 grams of black pigment (Nipex-35) and 701.55 grams of DI water. Subsequently, 2.70 grams of PAC (poly-aluminum chloride) was mixed with 33.30 g of 0.02M nitric acid, and then added to the slurry under homogenization at 3000-4000 RPM, and the pH was adjusted from 5.50 to 4.51 with 6.54 grams of 0.3M nitric acid. The reactor was set to 240 RPM and was heated to 47° C. to aggregate the toner particles. When the particle size reached about 5.9 microns, a shell coating of 47.0 grams styrene-acrylate latex emulsion C and 10.08 grams of paraffin wax, was added to the reactor and the stirring speed was increased to 340 RPM. When the toner particle size reached about 6 microns, the stirring speed was lower to 95 RPM and particle freezing was initiated by pH adjusting the slurry with 11.25 grams of a chelating agent (Versene™ 100) until pH reached 7.74. The reactor temperature was then ramped to 70° C. Once at 70° C., the pH of the slurry was reduced from 7.40 to 4.00 with 74.92 grams of 0.3M nitric acid. The reactor temperature was held at 70° C. for 90 minutes until the particle circularity was around 0.985 as measured by the Flow Particle Image Analysis (FPIA 3000) instrument. The slurry was then quench cooled in 729.5 g DI ice to a temperature of about 25° C. The final particle size was 6.08 microns, GSDv 1.19, GSDn 1.23 and a circularity of 0.987. The toner was then washed and freeze-dried.

Preparation of Hybrid Toner. Comparative Example II

Comparative Example II was prepared using the same process described in Comparative Example I except a shell coating of 47.0 grams styrene-acrylate latex emulsion C and 10.15 grams of S-973 wax instead of paraffin wax, was added to the reactor. Comparative Example II was coalesced at 65° C., pH 4.0 for 90 minutes with a final particle size of 6.1 microns, GSDv 1.18, GSDn 1.23 and a circularity of 0.983. The toner was then washed and freeze-dried.

Preparation of Hybrid Toner. Comparative Example III

To the 2 L glass reactor was added 92.90 grams of amorphous polyester emulsion A, 93.43 g of amorphous polyester emulsion B, 79.11 grams of styrene-acrylate latex emulsion C, 31.53 grams of crystalline polyester emulsion D, 20.30 grams of S-973 wax, 10.46 grams of cyan pigment (PB15:3), 55.10 grams of black pigment (Nipex-35) and 699.18 grams of DI water. Subsequently, 2.70 grams of PAC (poly-aluminum chloride) was mixed with 33.30 grams of 0.02M nitric acid, and then added to the slurry under homogenization at 3000-4000 RPM, and the pH was adjusted from 5.56 to 4.50 with 6.28 grams of 0.3M nitric acid. The reactor was set to 350 RPM and was heated to 47° C. to aggregate the toner particles. When the particle size reached about 5.9 microns, a shell coating of 47.29 grams styrene-acrylate latex emulsion C was added to the reactor and the stirring speed was reduced to 300 RPM. When the toner particle size reached about 6 microns, the stirring speed was lowered further to 90 RPM and particle freezing was initiated by pH adjusting the slurry with 11.46 grams of a chelating agent (Versene™ 100) until pH reached 7.82. The reactor temperature was then ramped to 65° C. Once at 65° C., the pH of the slurry was reduced from 7.47 to 4.04 with 74.16 grams of 0.3M nitric acid. The slurry was coalesced for 90 minutes at 65° C. until the particle circularity was 0.991 as measured by the Flow Particle Image Analysis (FPIA 3000) instrument. The slurry was then quench cooled in 726.19 grams DI ice to a temperature of about 25° C. The final particle size was 6.24 microns, GSDv 1.21, GSDn 1.21 and a circularity of 0.991. The toner was then washed and freeze-dried.

Preparation of Hybrid Toner. Example I

To the 2 L glass reactor was added 81.55 grams of amorphous polyester emulsion A, 90.64 grams of amorphous polyester emulsion B, 75.84 grams of styrene-acrylate latex emulsion C, 31.73 grams of crystalline polyester emulsion D, 20.30 grams of S-973 wax, 9.91 grams of cyan pigment (PB15:3), 51.65 grams of black pigment (Nipex-35) and 700.04 grams of DI water. Subsequently, 2.70 grams of PAC (poly-aluminum chloride) was mixed with 33.30 grams of 0.02M nitric acid, and then added to the slurry under homogenization at 3000-4000 RPM, and the pH was adjusted from 5.22 to 3.03 with 14.04 grams of 0.3M nitric acid. The reactor was set to 330 RPM and was heated to 40° C. to aggregate the toner particles. When the particle size reached about 5.8 microns, a shell coating of 46.68 grams styrene-acrylate latex emulsion C and 10.08 grams of paraffin wax, was added to the reactor. When the toner particle size reached about 6 microns, the stirring speed was lowered to 40 RPM and particle freezing was initiated by pH adjusting the slurry with 13.73 grams of a chelating agent (Versene™ 100) until pH reached 7.83. The reactor temperature was then ramped to 65° C. Once at 65° C., the pH of the slurry was reduced from 7.26 to 4.03 with 90.25 grams of 0.3M nitric acid. The reactor temperature was further ramped to 70° C. Once at the coalescence temperature, the slurry was coalesced for 90 minutes until the particle circularity was 0.965-0.970 as measured by the Flow Particle Image Analysis (FPIA 3000) instrument. The slurry was then quench cooled in 851.5 grams DI ice to a temperature of about 25° C. The final particle size was 6.68 microns, GSDv 1.32, GSDn 1.30 and a circularity of 0.961. The toner was then washed and freeze-dried.

Preparation of Hybrid Toner. Example II

Example II was prepared using the same process described in Example I except that 3.4% crystalline polyester emulsion D (15.76 grams) instead of 6.8% was added to the reactor during preparation. Example II was coalesced at 70° C., pH 4.0 for 40 minutes and cooled down to 65° C. for the last 50 minutes resulting in a final particle size of 6.61 microns, GSDv 1.28, GSDn 1.29 and a circularity of 0.960. The toner was then washed and freeze-dried.

Preparation of Hybrid Toner. Example III

To the 2 L glass reactor was added 98.04 grams of amorphous polyester emulsion A, 97.06 grams of amorphous polyester emulsion B, 81.22 grams of styrene-acrylate latex emulsion C, 20.30 grams of S-973 wax, 20.16 grams of paraffin wax, 9.91 grams of cyan pigment (PB15:3), 51.65 grams of black pigment (Nipex-35) and 710.68 grams of DI water. Subsequently, 2.70 grams of PAC (poly-aluminum chloride) was mixed with 33.30 grams of 0.02M nitric acid, and then added to the slurry under homogenization at 3000-4000 RPM, and the pH was adjusted from 5.07 to 3.01 with 13.55 grams of 0.3M nitric acid. The reactor was set to 335 RPM and was heated to 46° C. to aggregate the toner particles. When the particle size reached about 5.5 microns, a shell coating of 46.68 grams styrene-acrylate latex emulsion C was added to the reactor. When the toner particle size reached about 6 microns, the stirring speed was lowered to 40 RPM and particle freezing was initiated by pH adjusting the slurry with 16.26 grams of a chelating agent (Versene™ 100) until pH reached 7.87. The reactor temperature was then ramped to 65° C. Once at 65° C., the pH of the slurry was reduced from 7.37 to 4.02 with 97.37 grams of 0.3M nitric acid. The reactor temperature was further ramped to 70° C. Once at the coalescence temperature, the slurry was coalesced for 90 minutes until the particle circularity was 0.950 as measured by the Flow Particle Image Analysis (FPIA 3000) instrument. The slurry was then quench cooled in 713.1 grams DI ice to a temperature of about 25° C. The final particle size was 6.41 microns, GSDv 1.33, GSDn 1.33 and a circularity of 0.950. The toner was then washed and freeze-dried.

Preparation of Hybrid Toner. Example IV

Example IV was prepared using the same process described in Example I and II except that no crystalline polyester emulsion D was added to the core particle during preparation. Example IV was coalesced at 70° C., pH 4.0 for the whole 90 minutes resulting in a final particle size of 6.90 microns, GSDv 1.31, GSDn 1.27 and a circularity of 0.947. The toner was then washed and freeze-dried.

Preparation of Hybrid Toner. Example V

To the 2 L glass reactor was added 92.90 grams of amorphous polyester emulsion A, 93.43 grams of amorphous polyester emulsion B, 79.11 grams of styrene-acrylate latex emulsion C, 31.53 grams of crystalline polyester emulsion D, 10.15 grams of S-973 wax, 10.46 grams of cyan pigment (PB15:3), 55.10 grams of black pigment (Nipex-35) and 706.06 grams of DI water. Subsequently, 2.70 grams of PAC (poly-aluminum chloride) was mixed with 33.30 grams of 0.02M nitric acid, and then added to the slurry under homogenization at 3000-4000 RPM, and the pH was adjusted from 5.43 to 4.50 with 5.86 grams of 0.3M nitric acid. The reactor was set to 350 RPM and was heated to 50° C. to aggregate the toner particles. When the particle size reached about 5.9 microns, a shell coating of 47.29 grams styrene-acrylate latex emulsion C and 10.08 grams of paraffin wax, was added to the reactor. When the toner particle size reached about 6 microns, the stirring speed was lowered to 95 RPM and particle freezing was initiated by pH adjusting the slurry with 10.85 grams of a chelating agent (Versene™ 100) until pH reached 7.81. The reactor temperature was then ramped to 70° C. Once at 70° C., the pH of the slurry was reduced from 7.40 to 4.01 with 73.03 grams of 0.3M nitric acid. The slurry was coalesced for 90 minutes at 70° C. until the particle circularity was 0.970-0.980 as measured by the Flow Particle Image Analysis (FPIA 3000) instrument. The slurry was then quench cooled in 712.6 grams DI ice to a temperature of about 25° C. The final particle size was 6.61 microns, GSDv 1.21, GSDn 1.28 and a circularity of 0.974. The toner was then washed and freeze-dried.

TABLE 3

| | Comparative Example I | Comparative Example II | Comparative Example III |
|---|---|---|---|
| Core Wax | None | None | 4% S-973 |
| Shell Wax | 2% Paraffin | 2% S-973 | None |
| CPE | 6.8% C12:C6 | 6.8% C12:C6 | 6.8% C12:C6 |
| Core/Shell Styrene-Acrylate | 30%/12.5% | 30%/12.5% | 30%/12.5% |

TABLE 4

| | Example I | Example II | Example III | Example IV | Example V |
|---|---|---|---|---|---|
| Core Wax | 4% S-973 | 4% S-973 | 4% S-973 4% Paraffin | 4% S-973 | 2% S-973 |

TABLE 4-continued

| | Example I | Example II | Example III | Example IV | Example V |
|---|---|---|---|---|---|
| Shell Wax | 2% Paraffin | 2% Paraffin | None | 2% Paraffin | 2% Paraffin |
| CPE | 6.8% C12:C6 | 3.4% C12:C6 | None | None | 6.8% C12:C6 |
| Core/Shell Styrene-Acrylate | 30%/12.5% | 30%/12.5% | 30%/12.5% | 30%/12.5% | 30%/12.5% |

Process conditions for preparation of the Comparative Example and Example toners are shown in Tables 5 and 6.

TABLE 5

| | | Comparative Example I | Comparative Example II | Comparative Example III |
|---|---|---|---|---|
| Coalescence | 85° C./pH~7/t = 90' | 70° C./pH = 4/t = 90' | 65° C./pH = 4/t = 90' | 65° C./pH = 4/t = 90' |
| Size/GSDv/n | 5.3-6.1/1.23/1.30 | 6.1/1.19/1.23 | 8.2/1.23/1.42 | 6.2/1.21/1.21 |
| Circularity | 0.965-0.975 | 0.987 | 0.983 | 0.991 |
| Surface | | Some uncoalesced latex | Rough | Bumpy |
| ICP-Al | 200-400 | 416 | 410 | 420 |

TABLE 6

| | Example I | Example II | Example III | Example IV | Example V |
|---|---|---|---|---|---|
| Coalescence | 70° C. pH = 4 t = 90' | 70° C. pH = 4/ t = 40' to 65°C./ t = 50' | 70° C. pH = 4 t = 90' | 70° C. pH = 4 t = 90' | 70° C. pH = 4 |
| Size/GSDv/n | 6.7/1.3/1.30 | 6.6/1.28/1.29 | 6.4/1.33/1.33 | 6.9/1/31/1.27 | 6.6/1.21/1.28 |
| Circularity | 0.961 | 0.96 | 0.95 | 0.947 | 0.974 |
| Surface | Smooth | Bumpy | Bumpy | Smooth | Smooth |
| ICP-Al | 210 | 553 | 425 | 433 | 447 |

Dielectric Loss Measurement.

Dielectric loss of the parent toner particles, toner particles without external additives, was measured in a custom-made fixture connected to an HP4263B LCR Meter via shielded 1 meter BNC cables. To ensure reproducibility and consistency, one gram of toner (conditioned in J-zone 24 hours) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric and dielectric loss were determined by measuring the capacitance (Cp) and the loss factor (D) at 100 KHz frequency and 1 VAC. The measurements were carried out under ambient conditions. The dielectric constant was calculated as:

$$E'=[Cp(\text{pF})\times\text{Thickness(mm)}]/[8.854\times\text{Aeffective}(\text{m}^2)]$$

Here 8.854 was just the vacuum electrical permittivity epsilon(o), but in units that take into account the fact that Cp was in picofarads, not farads, and thickness was in mm (not meters). Aeffective was the effective area of the sample.

Dielectric loss=E*Dissipation factor, which was how much electrical dissipation there was in the sample (how leaky the capacitor was). This is multiplied by 1000 to simplify the values reported. Thus, a reported dielectric loss value of 70 indicates a dielectric loss of $70\times10^{-3}$, or 0.070.

Toner Additive Blending.

For each sample, about 50 g of the toner were added to an SKM mill along with surface additives and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging Measurement.

Toner charging was collected for the blended toner particle with surface additives. A mixture of 6 pph of toner in carrier was prepared by mixing 1.8 grams of toner and 30 grams of Xerox® 700 carrier in a 60 mL glass bottle. Samples were conditioned three days in a low-humidity zone (J zone) at 21.1° C. and 10% RH, and in a separate sample in a high humidity zone (A zone) at about 28° C./85% relative humidity. The developers with additive blended toner were charged in a Turbula mixer for 60 minutes. The toner charge was measured as the charge per mass ratio (Q/M) was also determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/M ratio.

Toner Blocking Measurement.

Toner blocking was determined by measuring the toner cohesion at elevated temperature above room temperature for the toner blended with surface additives. Toner blocking measurement was completed as follows: two grams of additive blended toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester. After the vibration was completed the sieves were reweighed and toner blocking is calculated from the total amount of toner remaining on both sieves as a percentage of the starting weight. Thus, for a 2 gram toner sample, if A is the weight of toner left the top 1000 μm screen and B is the weight of toner left the bottom 106 μm screen, the toner blocking percentage is calculated by: % blocking=50 (A+B).

Fusing Measurement.

Fusing characteristics of the toners blended with additives were determined by crease area, minimum fixing temperature, gloss, document offset, and vinyl offset testing.

All unfused images were generated using a modified Xerox copier. A TMA (Toner Mass per unit Area) of 1.00 mg/cm2 was used for the amount of toner placed onto Xerox® CXS paper (Color Xpressions® Select, 90 gsm, uncoated, P/N 3R11540) and used for gloss, crease and hot offset measurements. Gloss/crease targets were a square image placed in the centre of the page. Samples were then fused with an oil-less fusing fixture, consisting of a Xerox 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed, there is a wait time of ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the Hot offset temperature.

Crease Area.

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard Teflon™ coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity.

From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient.

Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

Minimum Fixing Temperature.

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss.

Print gloss (Gardner gloss units or "ggu") was measured using a 75 degree BYK Gardner gloss meter for toner images that had been fused at a fuser roll temperature range of about 120° C. to about 210° C. (sample gloss was dependent on the toner, the toner mass per unit area, the paper substrate, the fuser roll, and fuser roll temperature).

Gloss Mottle.

The gloss mottle temperature is the temperature at which the print shows a mottled texture, characterized by non-uniform gloss on the mm scale on the print, and is due to the toner beginning to stick to the fuser in small areas.

Hot offset. The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature.

Fusing results are shown in Tables 7 and 8. Developer Results are shown in Tables 9 and 10. MDSC Results are shown in Tables 11 and 12.

TABLE 7

| | Comparative Example I | Comparative Example II | Comparative Example III |
|---|---|---|---|
| ICP-Al | 131 | 124 | 127 |
| COT | 131 | 124 | 127 |
| Peak Gloss | 56.3 | 57.2 | 59.1 |
| T40 Gloss (° C.) | 138 | 131 | 126 |
| MFT (° C.) | 136 | 126 | 126 |
| Mottle Temperature (° C.) | 141 | 131 | 131 |
| HOT | 147 | 144 | 144 |

TABLE 8

| | Example I | Example II | Example III | Example IV | Example V |
|---|---|---|---|---|---|
| ICP-Al | 210 | 553 | 425 | 433 | |
| COT | 122 | 127 | 125 | 131 | 127 |
| Peak Gloss | 63.5 | 62.7 | 64.2 | 59.8 | 54 |
| T40 Gloss (° C.) | 124 | 134 | 149 | 147 | 131 |
| MFT (° C.) | 121 | 129 | 130 | 131 | 124 |
| Mottle Temperature (° C.) | 172 | 179 | 202 | 189 | 159 |
| HOT | 172 | 184 | 212 | 194 | 159 |

TABLE 9

| | Comparative Example I | Comparative Example II | Comparative Example III |
|---|---|---|---|
| Blocking (° C.) | 54.3 | 52 | 52.5 |
| Loss | 32 | 32 | 30 |
| Parent Q/M (μC/g) | 66.3/10.1 | 61.9/10.7 | 72/11.2 |
| Additive Q/M (μC/g) | 64.3/29.4 | 52.8/28.7 | 64.6/28.4 |

TABLE 10

| | Example I | Example II | Example III | Example IV |
|---|---|---|---|---|
| Blocking (° C.) | 52.5 | 52.8 | 52.1 | 52.6 |
| Loss | 51 | 36 | 39 | 36 |
| Parent Q/M (μC/g) | 72.5/10.4 | Not measured | 65.6/11 | Not measured |

TABLE 10-continued

| | Example I | Example II | Example III | Example IV |
|---|---|---|---|---|
| Additive Q/M (μC/g) | 63.8/28.8 | Not measured | 71.9/30.5 | Not measured |

TABLE 11

| | Comparative Example I | Comparative Example II | Comparative Example III |
|---|---|---|---|
| Peak 1 Onset Tm (° C.) | 61.2 | 61 | 61.4 |
| Peak 1 Peak Tm (° C.) | 64.5 | 64.3 | 64.9 |
| Peak 1 Offset Tm (° C.) | 72.5 | 76 | 75 |
| Peak 1 HoF (J/g) | 3.4 | 5.3 | 10.5 |
| Peak 2 Onset Tm (° C.) | 69.2 | No $2^{nd}$ peak | No $2^{nd}$ peak |
| Peak 2 Peak Tm (° C.) | 75.5 | No $2^{nd}$ peak | No $2^{nd}$ peak |
| Peak 2 HoF (J/g) | −1.62 | No $2^{nd}$ peak | No $2^{nd}$ peak |

TABLE 12

| | Example I | Example II | Example III | Example IV |
|---|---|---|---|---|
| Peak 1 Onset Tm (° C.) | 60.2 | 60.1 | 60 | 61 |
| Peak 1 Peak Tm (° C.) | 65.5 | 65.1 | 65.5 | 65.7 |
| Peak 1 Offset Tm (° C.) | 77.5 | 77.5 | 78 | 70.3 |
| Peak 1 HoF (J/g) | Not Measured | 8.4 | Not Measured | 6.0 |
| Peak 2 Onset Tm (° C.) | No $2^{nd}$ peak | No $2^{nd}$ peak | No $2^{nd}$ peak | No $2^{nd}$ peak |
| Peak 2 Peak Tm (° C.) | No $2^{nd}$ peak | No $2^{nd}$ peak | No $2^{nd}$ peak | No $2^{nd}$ peak |
| Peak 2 HoF (J/g) | No $2^{nd}$ peak | No $2^{nd}$ peak | No $2^{nd}$ peak | No $2^{nd}$ peak |

Comparative Example I with 2% paraffin wax in the shell and 6.8% of C12C6 crystalline polyester (CPE) in the core shows very low mottle temperature and HOT offset in the fuser, so fusing latitude to go to higher temperatures is narrow. Also, the morphology of the toner surface shows uncoalesced latex, so the toner morphology is poor. Because of the requirement to keep dielectric loss less than 65, it is not possible to increase the coalescence temperature to a higher temperature to increase the resin flow of the styrene/acrylate latex that forms the shell.

Comparative Example II with 2% S-973 ester wax replacing the paraffin wax in the shell and 6.8% C12C6 CPE in the core also shows very low mottle temperature and HOT offset. While morphology of this toner has improved, the surface is still rough and not ideal.

Comparative Example III increases the S-973 ester wax to 4% in the core, removing it from the shell, again with 6.8% of C12C6 CPE in the core, and still shows very low mottle temperature and HOT offset. Thus none of these comparative examples show good temperature fusing latitude to higher fuser temperatures. The morphology in this case is reasonably good, with a somewhat bumpy surface.

Example I adds 2% paraffin wax to the shell, continuing with 4% S-973 in the core. Fuser mottle temperature and HOT are increased dramatically compared to all the Comparative examples. Also the toner is glossier, with higher peak gloss and a lower gloss 40 temperature than all the comparative examples, and in addition the crease MFT is lower. As a result of the lower crease MFT and the higher mottle and HOT temperature, the fusing latitude is dramatically improved. Also the peak gloss is increased and the gloss 40 temperature is lower, which means that at all temperatures the toner will be glossier than those of the Comparative examples. Further, the crease MFT is reduced, thus the toner is lower melt than the Comparative examples. So Example I offers a lower melt toner with higher gloss and wider latitude to high fuser temperatures.

Example II reduces the CPE content by one-half to 3.4%, but retaining the wax formulation of Example I, with 4% S-973 in the core and 2% paraffin wax in the shell. The CPE is an expensive ingredient, so there is a cost benefit to reduce the CPE content. Also, the mottle temperature and HOT in fusing are both further increased compared to Example I, and to the Comparative Examples. For Example II the crease MFT and the gloss 40 temperature are in the range of the Comparative examples, while the peak gloss is higher than the Comparative examples. Example II then provides better fusing latitude to high temperatures than the Comparative Examples, but is not as glossy as Example I, though still glossier than the Comparative Examples at higher temperatures near the peak gloss.

Example III removes all of the CPE, with 4% S-973 and 4% paraffin wax in the core. Despite having no CPE and thus a less costly resin design, the crease MFT and thus low melt properties of the toner are retained, with crease MFT in the range of the Comparative examples. Example III provides an even further improved latitude to high fusing temperatures, an increase in 71° C. in mottle temperature and 68° C. in HOT compared to the best Comparative example III. Example III also has special gloss properties compared to the Comparative examples, and to Examples I and II. For Comparative example III for example, the toner fuses at 126° C. Since the Gloss 40 temperature is also 126° C., gloss for this toner once fused, is always 40 or higher. For Example III the toner fuses at 130° C., but gloss is less than 40° C. until 149° C., so if the fuser temperature is set in this range the toner will have gloss less than or equal to 40, and will be relatively low gloss. However, at higher temperature the toner can have high gloss up to the peak gloss of 64.2. Thus, the toner of Example III can provide both low gloss below 40 and high gloss above 40 over specific ranges of temperatures, which is not possible with any of the Comparative examples, as there is no or little temperature range that will provide low gloss and good crease MFT. This enables setting the printer to different temperature ranges to provide either low or high gloss images. The toner of Example III could be used in different printers with different fuser setpoints, to allow a printer that provides low gloss in one case, high gloss in the other.

Example IV also removes all CPE, with 4% S-973 in the core and lower 2% paraffin wax in the shell. Like Example III, Example IV provides a very wide fusing latitude to higher temperatures, with improved higher mottle temperature and HOT, with crease MFT, and thus low melt, in the range of the comparative examples without addition of CPE. Like Example III, Example IV provides low gloss less than about 40 between the crease MFT of 131° C. where the toner fuses, to the gloss 40 temperature of 147° C., and gloss above 40 at higher temperatures. Removing CPE provides a large cost reduction, as S-973 wax dispersion is much less expensive than CPE.

Example V reduces the total wax loading to 4%, with 2% of the S-973 ester wax in the core and 2% of the paraffin wax in the shell, but with the full amount of CPE at 6.8%. Fusing latitude is expanded compared to the Comparative examples, and the crease MFT is lower than the best Comparative Example. Gloss 40 temperature is in the range of the Comparative Examples, and in this case peak gloss is lower. Compared to the Comparative Examples, Example V is lower melt, with improved fuser latitude to higher temperature, and with gloss in a similar range as the Comparative Examples.

The Examples of this invention provide a wider fusing latitude compared to the Comparative examples and low melt with less or even without the crystalline polyester resin. This provides a wide range of gloss behavior that is not achieved in a hybrid design of the Comparative examples, and thus to provide low gloss, high gloss and gloss switching designs where gloss can be switched from below 40, to above 40, by varying the fuser temperature.

A main benefit of the toners of the present disclosure is lower cost. Further the waxes employed have very low weight loss at elevated temperature. For example, the Chukyo Yushi Co. waxes brochure shows that these waxes have very low weight loss at elevated temperature, which is believed to reduce the amount of volatiles and wax particulates at high temperature. The wax in toner is a major source of airborne nanoparticulates and thus has generated some concerns as a potential health hazard. Thus, the reduction of these particulates lessens environmental pollution and any potential hazard.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A hybrid toner composition comprising:

a first wax;

a second wax that is different from the first wax;

wherein the first wax comprises a paraffin wax having a peak melting point of from about 60 to about 80° C.;

wherein the second wax comprises an ester wax having a peak melting point of from about 60 to about 80° C.;

a first resin comprising an amorphous polyester and a second resin comprising at least one of a styrene, an acrylate, or a combination thereof; and an optional colorant.

2. The hybrid toner composition of claim 1, wherein the first wax is a paraffin wax having a carbon/oxygen ratio of greater than about 50.

3. The hybrid toner composition of claim 1, wherein the second wax is an ester wax having a carbon/oxygen ratio of less than about 50.

4. The hybrid toner composition of claim 1, wherein the first wax and the second wax each have an onset melting temperature of greater than about 55° C.

5. The hybrid toner composition of claim 1, further comprising a core-shell configuration;

wherein the core comprises a styrene-acrylate resin and an amorphous polyester resin; and wherein the shell comprises a styrene-acrylate resin.

6. The hybrid toner composition of claim 1, wherein the second resin comprises at least one of a styrene monomer, an acrylic acid monomer, an acrylic ester monomer, an acrylate, a styrene-acrylate copolymer, or a combination thereof.

7. The hybrid toner composition of claim 1, wherein the toner is substantially free of crystalline polyester resin.

8. The hybrid toner composition of claim 1, wherein the toner comprises crystalline polyester in an amount of less than about 4 percent by weight based upon the total weight of the toner composition.

9. The hybrid toner composition of claim 8, wherein the crystalline polyester has an onset melting temperature of greater than about 55° C. and an offset melting temperature of less than about 80° C., such that only a single peak is observed in the MDSC of the toner.

10. The hybrid toner composition of claim 1, wherein the toner has a core-shell configuration;

wherein the core comprises the first resin comprising an amorphous polyester and the second resin, wherein the second resin is a styrene-acrylate resin; and optionally, a colorant;

wherein the shell comprises a styrene-acrylate resin; and wherein the toner comprises crystalline polyester in an amount of less than about 4 percent by weight based upon the total weight of the toner composition.

11. The hybrid toner composition of claim 10, wherein the core is substantially free of crystalline polyester resin.

12. The hybrid toner composition of claim 10, wherein the core, the shell, or both the core and the shell comprise a paraffin wax having a peak melting point of less than about 80° C.

13. The hybrid toner composition of claim 10, wherein the core, the shell, or both the core and the shell comprise an ester wax having a peak melting point of less than about 70° C.

14. The hybrid toner composition of claim 1, further comprising a naphthalene sulphonic acid polymeric surfactant.

15. The hybrid toner composition of claim 1, wherein the toner further comprises a crystalline polyester resin having a peak melting point of less than about 80° C.;

wherein the difference between the peak melting point of the crystalline polyester resin and the peak melting point of the paraffin wax is less than about 15° C.; and wherein the difference between the peak melting point of the crystalline polyester resin and the peak melting point of the ester wax is less than about 15° C.

16. The hybrid toner composition of claim 1, wherein the toner colorant comprises carbon black.

17. The hybrid toner composition of claim 1, further comprising beta-carboxyethyl acrylate in an amount of from about 1 to about 2 parts per hundred.

18. The hybrid toner composition of claim 10, wherein the shell further comprises beta-carboxyethyl acrylate in an amount of from about 1 to about 2 parts per hundred.

19. A process for preparing a hybrid toner composition comprising:

mixing a first latex resin comprising an amorphous polyester and a second latex resin comprising at least one of a styrene, an acrylate, or a combination thereof, an optional crystalline polyester latex, an optional colorant, a first wax, and a second wax that is different from the first wax;

wherein the first wax comprises a paraffin wax having a peak melting point of from about 60 to about 80° C.;

wherein the second wax comprises an ester wax having a peak melting point of from about 60 to about 80° C.;

optionally, adding a coagulant to the mixture;

heating the mixture to a temperature below the glass transition temperature of at least one of the first or second latex resin to form aggregated particles;

heating the mixture to a temperature above the glass transition temperature of at least one of the first or second latex resin to coalesce the aggregated particles; and optionally, isolating the toner particles.

20. A process for preparing a hybrid toner having a core and a shell, comprising:

mixing a first latex resin comprising an amorphous polyester and a second latex resin comprising at least one of a styrene, an acrylate, or a combination thereof, an optional crystalline polyester latex, an optional colorant, a first wax, and a second wax that is different from the first wax;

wherein the first wax comprises a paraffin wax having a peak melting point of from about 60 to about 80° C.;

wherein the second wax comprises an ester wax having a peak melting point of from about 60 to about 80° C.;

to form a core mixture;

optionally, adding a coagulant to the core mixture;

heating the core mixture to a temperature below the glass transition temperature of at least one of the first latex resin or the second latex resin to aggregate the core mixture to form aggregated core particles;

mixing a third latex resin comprising at least one styrene-acrylate resin and a coalescent agent to form a shell mixture;

coating the shell mixture onto the aggregated core particles;

heating the shell mixture and the aggregated core particles to a temperature above the glass transition temperature of at least one of the first latex resin, the second latex resin, or the third latex resin to coalesce the aggregated core particles to form toner particles; and optionally, isolating the toner particles.

21. A hybrid toner composition comprising:

a first wax;

a second wax that is different from the first wax;

wherein the first wax comprises a paraffin wax;

wherein the second wax comprises an ester;

a first resin comprising an amorphous polyester and a second resin comprising at least one of a styrene, an acrylate, or a combination thereof; and an optional colorant.

22. The hybrid toner composition of claim 21, wherein the toner is substantially free of crystalline polyester resin.

23. The hybrid toner composition of claim 21, wherein the toner further comprises crystalline polyester and wherein the crystalline polyester is present in an amount of less than about 4 percent by weight based upon the total weight of the toner composition.

24. The hybrid toner composition of claim 23, wherein the crystalline polyester has an onset melting temperature of greater than about 55° C. and an offset melting temperature of less than about 80° C., such that only a single peak is observed in the MDSC of the toner.

* * * * *